US006508149B1

(12) United States Patent
Heggemann et al.

(10) Patent No.: US 6,508,149 B1
(45) Date of Patent: Jan. 21, 2003

(54) PLIERS

(75) Inventors: Christian Heggemann, Detmold (DE); Armin Herzog, Detmold (DE); Thorsten Bornefeld, Schlangen (DE)

(73) Assignee: Weidmüller Interface GmbH & Co., Detmold (DE)

( * ) Notice: Subject to any disclaimer, the term of this patent is extended or adjusted under 35 U.S.C. 154(b) by 29 days.

(21) Appl. No.: 09/644,811

(22) Filed: Aug. 24, 2000

(30) Foreign Application Priority Data

Aug. 24, 1999 (DE) ..... 299 14 763 U

(51) Int. Cl.[7] ..... B25B 7/14

(52) U.S. Cl. ..... 81/320; 81/342; 81/313; 81/322

(58) Field of Search ..... 81/342–344, 346–351, 81/384–386, 391–393, 313, 367, 319–323, 336, 364; 72/409.01, 409.12

(56) References Cited

U.S. PATENT DOCUMENTS

| | | | | |
|---|---|---|---|---|
| 3,243,880 A | * | 4/1966 | Weller | 81/342 |
| 3,253,487 A | * | 5/1966 | Bentley, Jr. | 81/342 |
| 3,273,240 A | | 9/1966 | Florian | |
| 3,888,003 A | * | 6/1975 | Brown | 81/301 X |
| 4,048,877 A | * | 9/1977 | Undin | 81/313 |
| 4,829,805 A | | 5/1989 | Koehn | |
| 5,280,716 A | | 1/1994 | Ryan et al. | |
| 5,842,371 A | | 12/1998 | Liaw | |

FOREIGN PATENT DOCUMENTS

| | | |
|---|---|---|
| DE | A2602491 | 10/1976 |
| DE | 296 19 451 U1 | 2/1997 |
| DE | U1-29619451 | 2/1997 |

* cited by examiner

*Primary Examiner*—D. S. Meislin
(74) *Attorney, Agent, or Firm*—Birch, Stewart, Kolasch & Birch, LLP

(57) ABSTRACT

Pliers with a first operating jaw and a first plier handle fixed thereto, have a second operating jaw mounted pivotably on the first operating jaw, and have a second plier handle which is articulated on a section of the second operating jaw. The section is oriented towards the rear plier end, having a connecting element between the first and second plier handles for the purpose of forming a toggle lever, and has a catch which is arranged at the front end of the second plier handle and is intended for preventing the plier handles from spreading apart before they have reached their closed position, the catch engaging, for this purpose, in a row of teeth. The row of teeth is provided on the second operating jaw.

12 Claims, 6 Drawing Sheets

PLIERS

BACKGROUND OF THE INVENTION

1. Field of the Invention

The invention relates to pliers.

2. Description of the Prior Art

Such pliers are known already from U.S. Pat. No. 5,842,371. These known pliers contain a first operating jaw and a first plier handle fixed thereto, a second operating jaw mounted pivotably on the first operating jaw, a second plier handle which is provided on a section of the second operating jaw which is oriented towards the rear plier end, a connecting element between the first and second plier handles for the purpose of forming a toggle lever, and a catch which is arranged at the front end of the second plier handle and intended for preventing the plier handles from spreading apart before they have reached their closed position, the catch engaging, for this purpose, in a row of teeth.

In the conventional pliers said row of teeth is located at the bottom end of the connecting element, the row of teeth being arranged coaxially with the point of articulation between the connecting element and second plier handle.

In order to ensure reliable locking of the pliers by the catch even in the case of very large plier-mouth forces, the teeth of the row of teeth have to be of relatively stable design. If a certain number of teeth is predetermined for the row of teeth, then the row of teeth has to be spaced apart by a relatively large distance from the abovementioned point of articulation. This results in the second plier handle, which accommodates the row of teeth and catch, having to be of relatively large design, which results in pliers which are not particularly compact. A reduction in size of the second plier handle would bring with it the risk of exposing parts of the row of teeth and catch, which would increase the risk of injury.

BRIEF SUMMARY OF THE INVENTION

The object of the invention is to design pliers of the type mentioned to be more compact in the handle region without the risk of injury to a user being increased as a result.

Pliers according to the invention are distinguished in that the row of teeth is provided on the second operating jaw.

According to the invention, the row of teeth, in which the catch engages, is thus shifted from the region of the plier handles into the region of the operating jaws since there is more space there for accommodating the row of teeth. The pliers may thus be of more compact configuration in the handle region. On account of the space provided, with the predetermined number of teeth, it is also possible for the teeth to be of relatively large and/or stable design, this ensuring a more reliable blocking operation of the pliers.

According to a very advantageous development of the invention, the second operating jaw has two legs which are spaced apart from one another in the plier plane, are oriented towards the rear plier end and of which that leg which is located closer to the first operating jaw is the leg which bears the row of teeth.

An operating jaw configured in this way first of all makes available a relatively large amount of space along the length of the leg for the purpose of forming the row of teeth, with result that, with a predetermined number of teeth, it is also possible for the row of teeth to be of relatively stable configuration. On the other hand, such an operating jaw has only very low weight since space remains between the legs and material is saved in this way. In this case, the row of teeth is located preferably coaxially with the point of articulation connecting the second operating jaw and the second; plier handle, which simplifies production and positioning of the catch and row of teeth.

According to another advantageous development, the row of teeth is located on that side of said leg which is located opposite the other leg, the catch, which is mounted pivotably on the second plier handle, being mounted between said legs., The catch may thus be accommodated more or less within the second operating jaw, with result that it is also possible to save space in the region of the operating jaws, which results in pliers which are even more compact.

A tension spring for prestressing the catch into its zero position is located between said catch and that end of the connecting element at which the abovementioned point of articulation is located. In this case, there may be, in the second plier handle, at least one opening for the purposes of unlocking the catch if the plier handles have not yet reached their closed position.

According to a very advantageous configuration of the invention, the two legs are parts of a central junction element of the pliers which is designed in the form of a U.

Said central junction element of the pliers assumes a number of tasks at the same time and can be produced easily, which has a positive effect on the production costs of the pliers as a whole.

It is thus not just said row of teeth which is provided in the central junction element. Rather, it is also the case that the point of articulation between the second operating jaw and second plier handle is arranged at the free end of that leg which is located opposite the row of teeth. For this purpose, a through-passage bore is provided there with the purpose of accommodating a corresponding articulation pin.

On the other hand, plates projecting towards the front plier end are provided on both sides of the central junction element for the purpose of forming a clamping jaw. For this purpose,the central junction element, in turn, is provided with corresponding through-passage bores for the purpose of accommodating screws and/or fastening pins.

The central junction element also has a through-passage bore for the purpose of accommodating a pivot pin, in order for it to be possible for the second operating jaw, comprising the central junction element and clamping jaw, to be mounted pivotably on the first operating jaw.

Also provided on the central junction element are mounts for a restoring spring by means of which the pliers are opened automatically once the plier handles have reached their closed position.

The central junction element is thus contained as the multifunctional element within the pliers and simplifies the production thereof to a considerable extent. It is thus possible for the central junction element to be of plate-like design, which facilitates the production thereof. In this case, it is possible for the teeth of said row of teeth to extend over the entire plate thickness, with result that a reliable locking action is achieved with the aid of the catch if the latter is of correspondingly thick configuration. It is possible for the plate-like junction element to be assembled, in particular, from a plurality of individual plates which may be produced by punching, this simplifying the production of the central junction element even further. In this it is also possible for the catch to comprise a catch pair, of which in each case one engages in a row of teeth on a lateral individual plate.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMDODIMENTS

Figure 1:
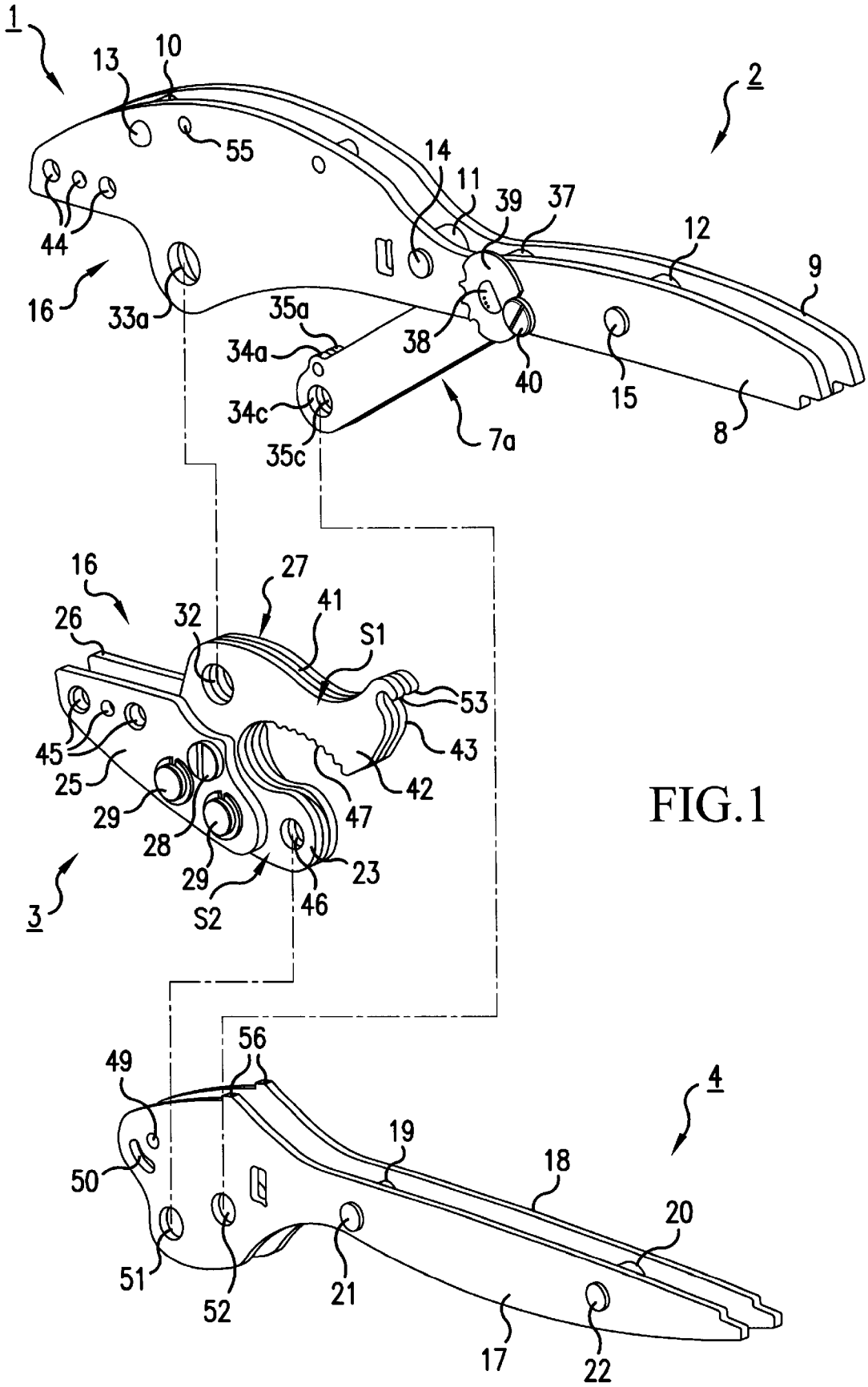
FIG. 1 shows an exploded illustration of a first exemplary embodiment of pliers according to the invention.

First of all, the exploded illustration in FIG. 1 will be used to explain in more detail the construction of the first exemplary embodiment of the pliers according to the invention;

The pliers according to FIG. 1 essentially comprise a first operating jaw 1;, a first plier handle 2, a second operating jaw 3, a second plier handle 4 and a relatively rigid connecting element 7*a*.

The first operating jaw l and the first plier handle 2 are connected integrally to one another. This structural unit comprises two mutually parallel plates 8 and 9 which are spaced apart via spacers 10, 11 and 12. Running through the plates 8i and 9 and the spacers 10 , 11 and 12 are bolts 13, 14 and 15 which hold the plates 8 and 9 together. The, plates 8 and 9 are recessed in the front region of the pliers for the purpose of forming a plier mouth 16.

The second plier handle 4 likewise comprises two mutually parallel plates 17 and 18 which are spaced apart from one another via spacers 19 and 20. Running through the plates 17 and 18 and, the spacers 19 and 20 are bolts 21 and 22 for holding the plates 17 and 18 together.

The second operating jaw 3 is shown in the central region of FIG. 1. It contains two clamping-jaw plates 25 and 26 which are spaced apart parallel to one another and are arranged oh opposite sides of a central junction element 27. The central junction element 27 is designed in the form of an U and has two legs oriented towards the rear plier end. The two clamping-jaws plates 25 and 26 are fastened in the region of the base, and of one leg, of the central junction element 27 with the aid screws 28 and bolts 29 and project from the base of the central junction element 27 in the direction of the front plier end. In the free end region, the clamping-jaw plates 25 and 26 form a clamping jaw which is located on the bottom side of the plier mouth 16.

The two legs of the central junction element 27 may be designated S1 and S2. The second plier handle 4 is mounted pivotably on the rear section 23 of the second operating jaw 3, that is to say at the free end of the leg S2. Serving for this purpose is a pin 24 which is shown in FIG. 2, passes through a through-passage opening 46 in the rear section 23 and rests in through-passage openings 51 which are located in the two plates 17 and 18 of the second plier handle 4.

Figure 2:
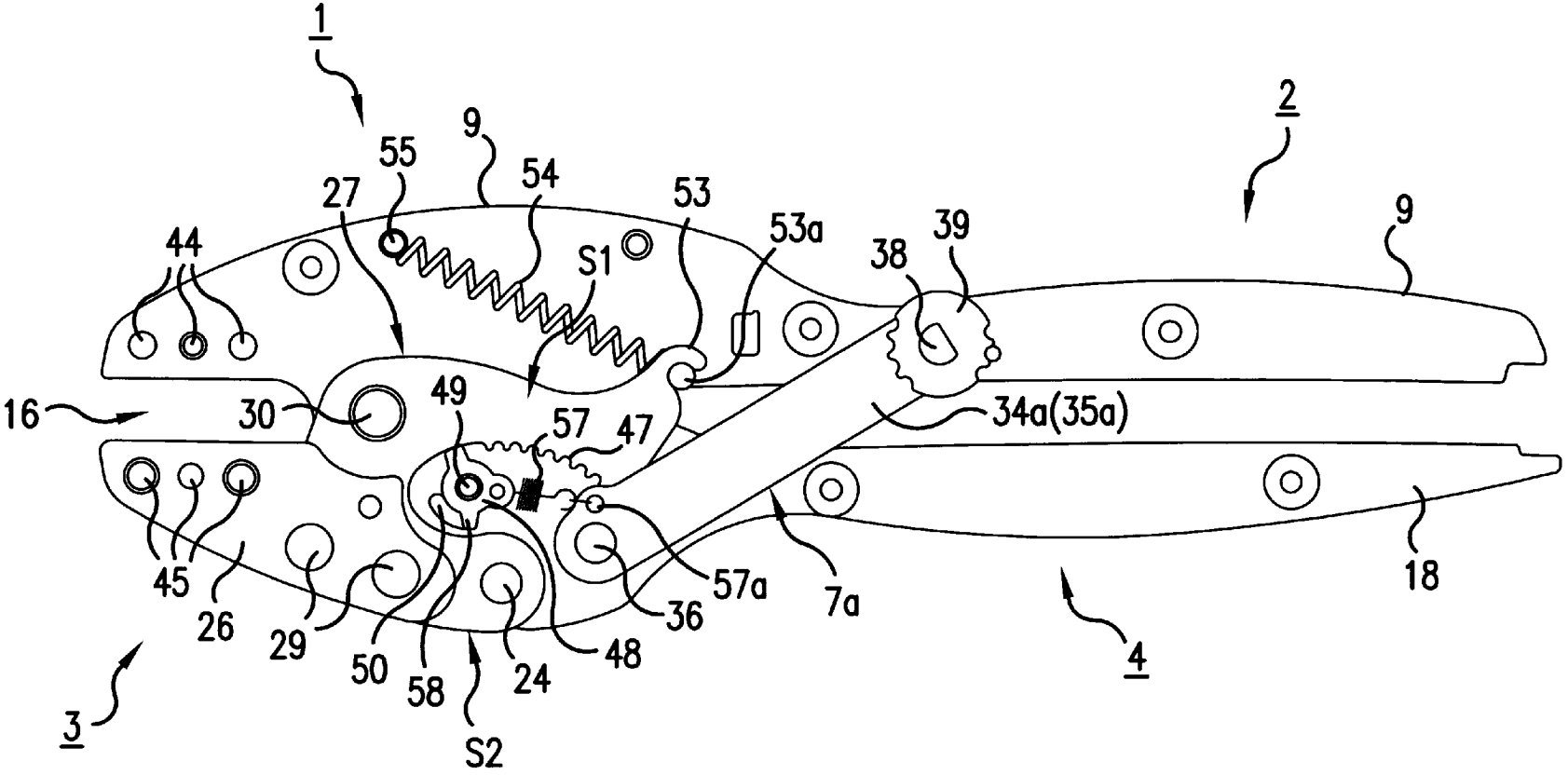
FIG. 2 shows a side view of the pliers according to FIG. 1 with the side plates removed.

The second operating jaw 3 itself is mounted in the bottom region of the first operating jaw 1 via a pivot pin 30, which is shown in FIG. 2. Provided for this purpose there, in the plates 8 and 9 is in each case one circular through-passage opening 33*a* which accommodates the pivot pin 30. The central junction element 37 is seated on said pivot pin 30, between the plates 8 and 9, the pivot pin: 30 running through a through-passage opening 32 which is located on the base of the central junction element 27 or on the foot of the leg S1.

The connecting element 7*a* comprises 2 plates 34*a* and 35*a* which are spaced apart parallel to one another. Said two plates 34*a* and 35*a* each have, in their bottom region, a through-passage opening 34*c*, 35*c* through which a common pin 36 runs. Said pin 36 can be seen in FIG. 2 and has its ends resting in through-passage openings 52 which are located in the front region of the plates 17, 18 of the second plier handle 4. In this case, the through-passage openings 52 are displaced towards the rear end of the pliers in relation to the through-passage openings 51.

At the other end, the plates 34*a* and 35*a* of the connecting element 7*a* are mounted pivotably on the first plier handle 2. They rest here on a concentrically mounted pin 37 which, on both sides, has journals 38 which rest in corresponding recess of the plates 8 and 9 (not shown). The axes of the journals 38 are offset in relation to the pin 37. Seated on one of the journals 38 is an adjusting disc 39 with lateral recesses (not indicated specifically) which serve for accommodating a screw 40 which can be screwed into the plate 8. If the screw 40 is released and the adjusting screw 39 rotated, then it is possible in this way to adjust the length of the connecting element 7*a* and thus to adjust the pliers in the region of the plier mouth 16. Once the end position of the adjusting disc 39 has been reached, the screw 40, which is then located in a correspondingly different lateral recess of the adjusting disc 39, is retightened and the system is thus fixed.

The construction of the central junction element 27 in FIG. 1 will be explained in more detail hereinbelow. Said junction element 27 is essentially designed in the form of a U and has two legs S1 and S2 projecting towards the rear plier end. In this case, the central junction element 27 comprises a central plate 41 which does not quite reach the end of the leg S1. Said central plate 41 may be produced, for example, from plastic. An outer plate 42, 43 is located in each case on both sides of the central plate 41. Said outer plates 42 and 43 consist of metal. All the plates 41, 42 and 43 may be produced by a punching process and are then positioned one upon the other and screwed together, the screw 28 serving for this purpose. Positioning of the plates 41, 42 and 43 relative to one another also takes place via the: bolts 29, which pass through said plates and the plates 25 and 26 and are retained in the system with the aid of securing rings.

A row of teeth 47 is located on the inside of the leg S1, that is to say on, that side which is directed towards the section 23. The row of teeth 47 is located concentrically with the through-passage bore 46, the teeth of the row of teeth 47 being located both in the plate 42 and in the plate 43.

Positioned, on the other hand, between the legs S1 and S2, and located opposite the row of teeth 47, is a catch 48 which can be best seen in FIG. 2. Said catch 48 is mounted such that it can be pivoted about a pin 49 which is retained in the front region of the second plier handle 4, between the plates 17 and 18, and can likewise be moved on a path concentric with the pin 24. For this purpose, the plates 17 and 18 are widened in their plate plane in the front region such that they accommodate between them the free ends of the legs S1 and S2 with the row of teeth 47 and the through-passage bore 46. The pin 49 thus runs through between the legs S1 and S2, with result that the catch 48 can be positioned in relation to the row of teeth 47. In this case, the catch 48 is longer, in the region between the pin 49 and row of teeth 47, than the distance between the row of teeth 47 and the pin 49. The catch 48 is in engagement with the row of teeth 47 when the plier handles 2 and 4 are closed or moved towards one another. In this case, the width, running perpendicularly to the plier plane, of the catch 48 is such that said catch comes into engagement with the two rows of teeth 47 on the plates 42 and 43. However, it is also possible for the catch 48 to be replaced by two parallel catches, as has already been mentioned. It is disengaged from the rows of teeth when the plier handles 2 and 4 have reached their closed position. Thereafter, the top stops 56 on the plates 17 and 18 strike against the opposite, bottom border of the plates 8 and 9.

Slots 50 are also located concentrically with the pin 49, in the plates 17 and 18 of the second plier handle 4, it being possible for the catch 48 to be disengaged manually from the row of teeth 47 through said slots should this be necessary, with the plier handles 2 and 4 not yet closed.

As can best be seen in FIG. 2, the catch 48 is drawn, by means of a tension spring 57, into a zero position, which is only actually assumed when the catch 48 is disengaged from the row of teeth 47. If the catch is in engagement with the row of teeth 47, it can yield, for example, as the plier mouth 16 closes and not in the opposite direction. In this case, the tension spring has one end fastened on the catch 48 and its other end fastened on the bottom region of the connecting element 7*a*. For this purpose, the tension spring has its last-mentioned end engaging around a pin 57*a* which runs between the plates 34*a* and 35*a*. The catch 48 can be disengaged from the row of teeth 47 via an extension 58, which is provided on the catch 48 and projects into the opening 50.

At the free end of the leg S1 of the central junction element 27, extensions 53 oriented in the direction of the rear plier end are located on the plates 42 and 43. These extensions 53 engage around a pin 53*a* which is illustrated in FIG. 2 and to which there is connected one end of a ,tension spring 54, said end then being located between the plates 42 and 43. The other end of the tension spring 54 is guided around a pin 55 located between the plates 8 and 9. The tension spring 54 serves for opening the pliers again automatically once the closed position of the plier handles 2 and 4 has been reached It should also be mentioned that, in FIGS. 1 and 2, 44 and 45 designate openings in the operating jaws 1 and 2 in the region of the plier mouth, via which it is possible to fasten on the operating jaws 1 and 2 elements for processing.

Figure 3:
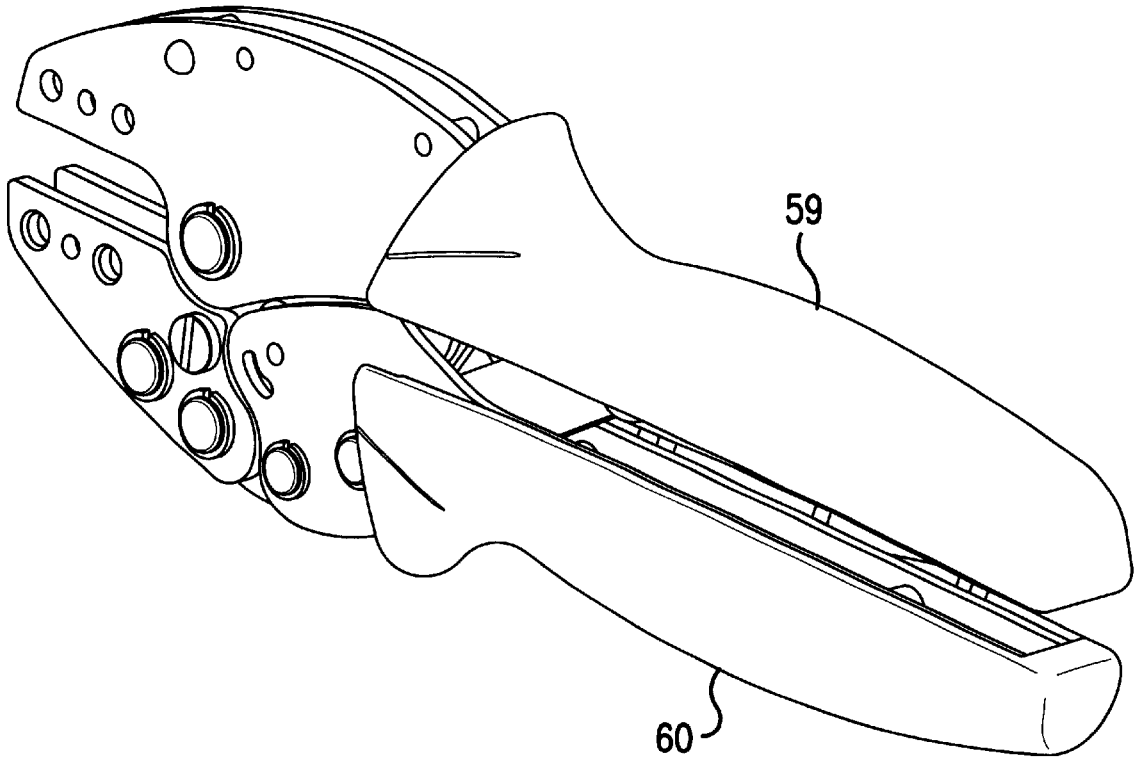
FIG. 3 shows a perspective view of the pliers according to FIG. 1 in the assembled state.

FIG. 3 shows the first exemplary embodiment of the pliers according to the invention in the assembled state with handle shells 59 and 60 on the plier handles 2 and 4.

Figure 4:
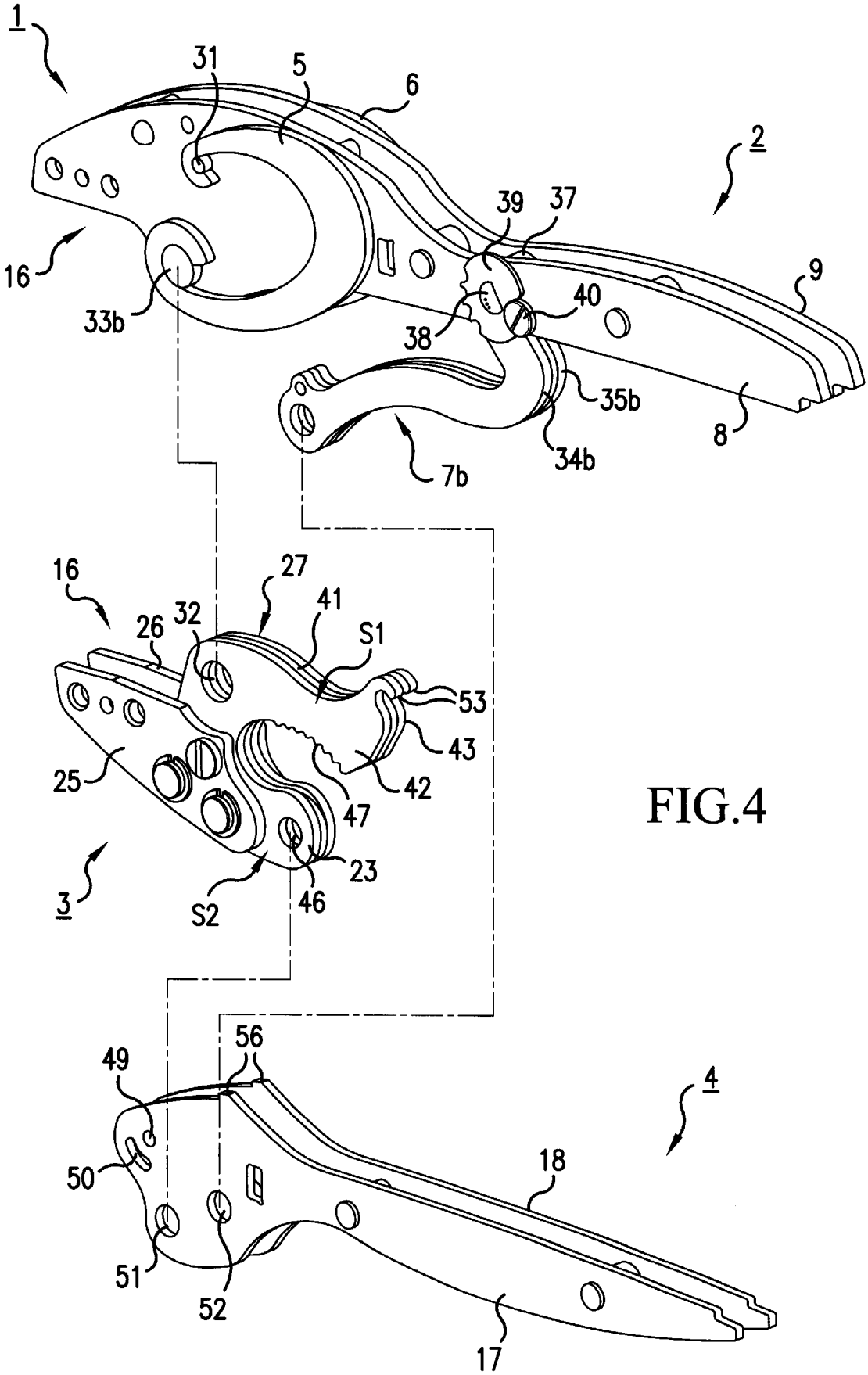
FIG. 4 shows a second exemplary embodiment of the pliers according to the invention.
Figure 5:
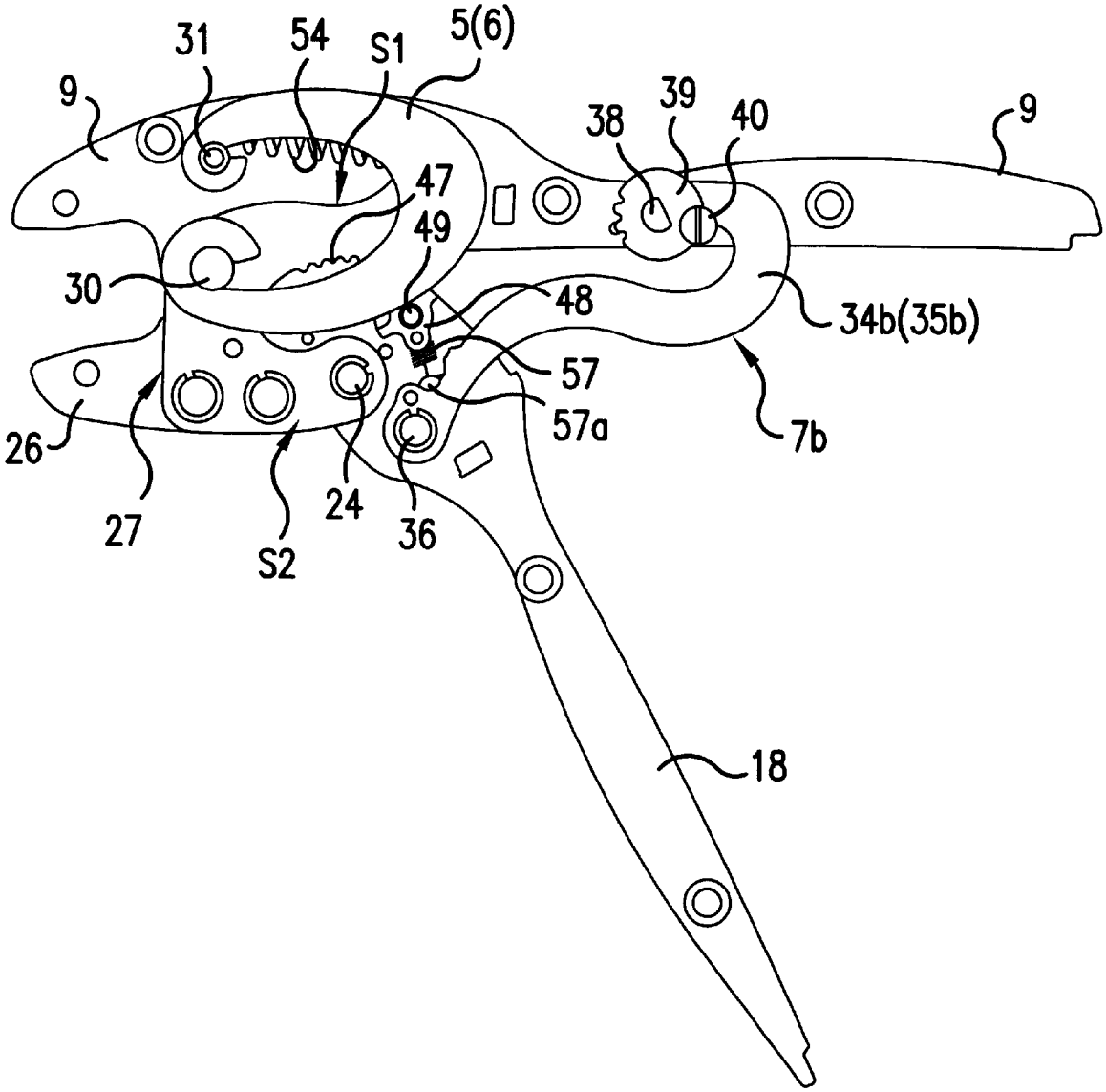
FIG. 5 shows a side view of the secondary exemplary embodiment of the pliers in the open state, with the side plates removed.
Figure 6:
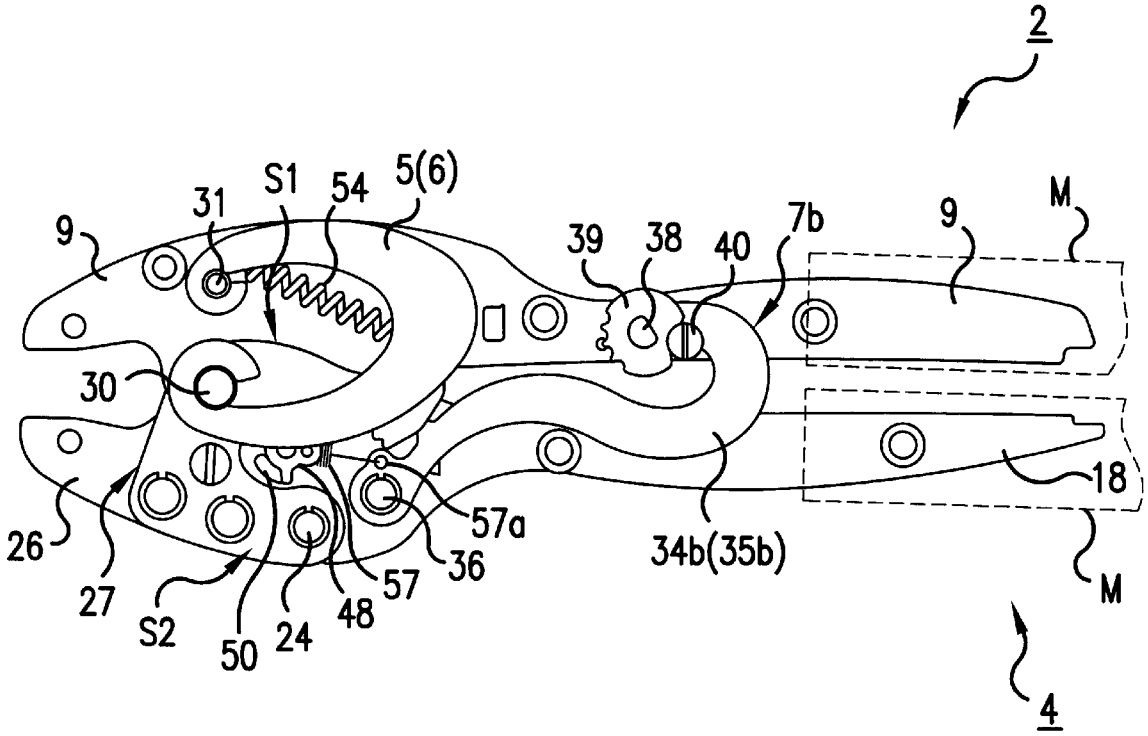
FIG. 6 shows the pliers; according to FIG. 5 in the closed state.

FIGS. 4 to 6 show a second exemplary embodiment of the pliers according to the invention. The same elements as in FIGS. 1 to 3 are provided with the same designations and will not be described again.

Unlike the exemplary embodiment according to FIG. 1, in this case the openings in the plates 8 and 9 for the purpose of accommodating the pivot pin 30 are designed as slots 33*b*, of which the longitudinal direction runs in the plates 8 and 9, at least more or less perpendicularly to the longitudinal direction of the pliers. The slots allow the pin to have limited movement and act as a stop at the movement limits. Located on the outsides of the two plates 8 and 9 are two plate springs 5 and 6 which are designed in the form of a V, U or Ω and of which one end engages around the pivot pin 30 in each case, while the other end of the respective springs 5 and 6 engages around a bolt 31 which is fixed on the first operating jaw 1 above the respective slot 33*b*, at a distance therefrom.

The connecting element 7*b* is likewise designed as a spring or compression spring with predetermined spring characteristic. It contains the spring plates 34*b* and 35*b* spaced apart parallel alongside one another and is located between the eccentrically mounted pin 37 and the pin 36. Otherwise, the construction of the second exemplary embodiment corresponds to the construction of the first exemplary embodiment.

The spring characteristics of the spring plates 5 and 6 and of the spring plates 34*b* and 35*b* are selected such that, during a first operating displacement of the operating jaws 1 and 3, over which the pivot pin 30 have not yet been moved against the stop formed by slot 33*b*, the force behaviour in the plier mouth 16 is determined essentially by the spring plates 5 and 6, albeit assisted (to some extent) by the spring plates 34*b* and 35*b*. Once the maximum deflection displacement for the spring plates 5 and 6 has been reached, and the pin 30 has thus been moved against the end-side stop of the slots 33*b*, the force behaviour in the plier mouth 16 is then determined merely by the spring properties of the spring plates 34*b* and 35*b*. The characteristics of all the spring plates, then, are preferably coordinated with one another such that a smooth transitions provided in the case of the pivot pin 30 striking against the end-side border of the slots 33*b*. If a certain limit force in the plier mouth is exceeded, and for the case where the spring plates 5 and 6 have already been moved against the stop, the adjusting element 7*b* then finally yields in order then to be able, when the plier mouth has not yet been closed completely, to transfer the plier handles 2 and 4 into the closed position. The abovementioned operating displacement begins when the tool elements have come into contact with the object which is to be processed.

Since, depending on load, the resilient connecting element 7*b* is adjusted, in terms of its angle position, relative to the second plier handle 4, it also advantageous in this embodiment for the row of teeth for the locking system not to be arranged on the connecting element 7*b*, since there would then be a risk of the catch 48 no longer engaging with the row of teeth in a desired manner. Instead, it is also the case here that the row of teeth 47 is located on the second operating jaw 3 or central junction element 27, with result that, unaffected by the plier position, the relative position between the catch pin 49 and row of teeth 47 always remains constant.

The pliers according to the invention may be provided as an individual tool or as an integrated constituent part of a machine tool. In the case of an individual tool, it is possible, according to one configuration of the invention, for the plier handles 2, 4 to be designed such that it is also possible for the pliers to be connected, via their plier handles, to a machine for driving the pliers. This gives a number of possible applications for the pliers. They may thus be actuated manually or driven in a machine-controlled manner, in order for it to be possible to carry out periodically recurring operations over a relatively long period of time. On the other hand, it is also possible, however, for the pliers as a whole, or in part, to be a permanent constituent part of a machine tool for driving the pliers. At least the plier handles may thus be part of said machine tool. In this case, it would be possible for the plier handles to be capable of being coupled to the rest of the parts of the pliers, as result of which the plier handles could be connected to respectively different plier parts of the type described above. It would thus be possible to take account of different dimensioning of the objects which are to be processed.

FIG. 6 illustrates by dashed lines, for example, a machine M connected to the plier handles 2, 4. In practice, the machine M simulates the movement of the plier handles 2, 4 for driving in the pliers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Pliers comprising a first operating jaw and a first plier handle fixed thereto, having a second operating jaw mounted pivotably on the first operating jaw having a second plier handle which is articulated on a section of the second operating jaw, said section being oriented towards a rear plier end, having a connecting element between the first and second plier handles for the purpose of forming a toggle lever, and having a catch which is arranged at a front end of the second plier handle and is intended for preventing the plier handles from spreading apart before they have reached their closed position with the catch then engaging in a row of teeth, wherein the row of teeth is provided on the second operating jaw;

the second operating jaw having two legs which are spaced apart from one another in a plier plane, are oriented towards the rear plier end and of which the leg which is located closer to the first operating jaw is the leg which bears the row of teeth.

2. The pliers according to claim 1, wherein the row of teeth is located coaxially with a point of articulation connecting the second operating jaw and the second plier handle.

3. The pliers according to claim 1, wherein the first and second plier handles are designed such that they are connectable to a machine for driving the pliers.

4. The pliers according to claim 1, wherein the row of teeth is located on that side of said leg which is located opposite the other leg, and in that the catch is mounted between said legs.

5. The pliers according to claim 4, wherein a tension spring for prestressing the catch is located between the catch and the connecting element.

6. The pliers according to claim 1, wherein there is at least one opening in the second plier handle for unlocking the catch.

7. The pliers according to claim 1, wherein the two legs are parts of a central junction element designed in the form of a U.

8. The pliers according to claim 7, wherein a point of articulation between the second operating jaw and the second plier handle is arranged at the free end of that leg which is located opposite the row of teeth.

9. The pliers according to claim 7, wherein the central junction element is of a plate design and the teeth of the row of teeth extend over the entire plate thickness.

10. The pliers according to claim 9, wherein the central junction element is assembled from a plurality of individual plates.

11. The pliers according to claim 7, wherein plates projecting towards a front plier end are provided on both sides of the central junction element for the purpose of forming a clamping jaw.

12. The pliers according to claim 1, wherein at least the first and second plier handles are parts of a machine for driving the pliers.

* * * * *